US008844181B2

(12) United States Patent
Wildrick et al.

(10) Patent No.: US 8,844,181 B2
(45) Date of Patent: Sep. 30, 2014

(54) BACK-LOADING PRODUCT DISPENSING HOOK

(71) Applicants: Richard J. Wildrick, Hunlock Creek, PA (US); Joseph F. Kologe, Scranton, PA (US)

(72) Inventors: Richard J. Wildrick, Hunlock Creek, PA (US); Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 0 days.

(21) Appl. No.: 13/903,492

(22) Filed: May 28, 2013

(65) Prior Publication Data

US 2014/0047745 A1 Feb. 20, 2014

Related U.S. Application Data

(60) Provisional application No. 61/683,484, filed on Aug. 15, 2012.

(51) Int. Cl.

| | |
|---|---|
| ***G09F 3/18*** | (2006.01) |
| ***A47F 1/04*** | (2006.01) |
| ***A47F 7/28*** | (2006.01) |
| ***A47F 5/08*** | (2006.01) |
| *G09F 3/20* | (2006.01) |
| *A47B 73/00* | (2006.01) |
| *G09F 3/04* | (2006.01) |

(52) U.S. Cl.

CPC ... *A47F 1/04* (2013.01); *G09F 3/20* (2013.01); *A47F 7/285* (2013.01); *A47B 73/004* (2013.01); *G09F 3/04* (2013.01); *G09F 3/204* (2013.01); *A47F 5/0838* (2013.01)

USPC ..... 40/661.03; 211/59.2

(58) Field of Classification Search

CPC ..... A47F 5/0823; A47F 5/0869; A47F 7/285; G09F 3/04; G09F 3/20; G09F 3/204

USPC ..... 40/661.03; 211/592

See application file for complete search history.

(56) References Cited

U.S. PATENT DOCUMENTS

| | | | | |
|---|---|---|---|---|
| 4,022,363 | A | 5/1977 | Eliassen | |
| 4,310,097 | A | 1/1982 | Merl | |
| 4,327,836 | A * | 5/1982 | Okuno | 211/74 |
| 4,401,221 | A * | 8/1983 | Suttles | 211/59.2 |
| 4,540,093 | A * | 9/1985 | Merl et al. | 211/59.1 |
| 4,863,131 | A | 9/1989 | Kinseley | |
| 5,586,687 | A | 12/1996 | Spamer et al. | |
| 5,669,527 | A * | 9/1997 | Hardy | 221/191 |

(Continued)

*Primary Examiner* — Charles A Fox
*Assistant Examiner* — Shin Kim
(74) *Attorney, Agent, or Firm* — St. Onge Steward Johnston & Reens LLC

(57) ABSTRACT

A back-loading display hook for the dispensing of products having limited shelf life, where the products are supplied in containers having enlarged tops and narrower necks. Spaced apart support rods, extend forwardly, spaced to accommodate the necks, while suspending the products by their tops. The inner ends of the product rods are spaced apart a greater distance, sufficient to receive the enlarged tops of the products and form a loading position. The products are loaded by moving the tops upward in the loading position, and then sliding them forward onto the narrower portions of the support rods. A stop element is associated with the load position, and is displaceable to allow upward loading of the products onto the support rods, while preventing rearward movement of products back into the load position. Optionally, the display hook may be disposed horizontally, or inclined to cause the products to advance forward by gravity.

16 Claims, 6 Drawing Sheets

(56) References Cited

U.S. PATENT DOCUMENTS

| | | | | | |
|---|---|---|---|---|---|
| 5,695,074 | A | * | 12/1997 | Wiese | 211/59.2 |
| 5,706,957 | A | * | 1/1998 | Hardy | 211/59.2 |
| 5,706,958 | A | * | 1/1998 | Spamer | 211/59.2 |
| 5,706,978 | A | * | 1/1998 | Spamer et al. | 221/298 |
| 5,709,297 | A | * | 1/1998 | Brandriff et al. | 206/6.1 |
| 5,718,341 | A | * | 2/1998 | Robertson | 211/59.2 |
| 5,755,341 | A | * | 5/1998 | Spamer | 211/59.2 |
| 5,779,068 | A | * | 7/1998 | Whiten et al. | 211/117 |
| 5,785,189 | A | | 7/1998 | Gollob et al. | |
| 5,788,091 | A | * | 8/1998 | Robertson et al. | 211/59.2 |
| 5,848,698 | A | * | 12/1998 | Stompe | 206/449 |
| 5,865,326 | A | | 2/1999 | Spamer et al. | |
| 5,875,919 | A | * | 3/1999 | Spamer et al. | 221/289 |
| 6,059,125 | A | * | 5/2000 | Parham | 211/59.2 |
| 6,141,894 | A | * | 11/2000 | Thalenfeld et al. | 40/642.01 |
| 6,283,278 | B1 | * | 9/2001 | Holztrager | 206/6.1 |
| 6,302,279 | B1 | * | 10/2001 | Robolin | 211/59.2 |
| 6,360,901 | B1 | * | 3/2002 | Parham | 211/59.2 |
| 6,394,288 | B1 | | 5/2002 | Hartwall | |
| 6,523,719 | B2 | | 2/2003 | Trulaske, Sr. | |
| 6,640,983 | B2 | * | 11/2003 | Miller, Jr. | 211/85.29 |
| 7,975,416 | B2 | * | 7/2011 | Engelby et al. | 40/661.03 |
| 8,171,663 | B1 | * | 5/2012 | Engelby et al. | 40/661.03 |
| 8,302,338 | B2 | * | 11/2012 | Engelby et al. | 40/661.03 |
| 8,499,941 | B2 | * | 8/2013 | Barkdoll et al. | 211/59.1 |
| 2002/0066744 | A1 | * | 6/2002 | Trulaske, Sr. | 221/295 |
| 2002/0124450 | A1 | * | 9/2002 | Valiulis | 40/638 |
| 2002/0185461 | A1 | * | 12/2002 | Miller, Jr. | 211/85.29 |
| 2011/0232144 | A1 | * | 9/2011 | Engelby et al. | 40/642.02 |

* cited by examiner

BACK-LOADING PRODUCT DISPENSING HOOK

FIELD OF THE INVENTION

The present invention relates to product display hooks, such as typically are mounted on perforated panel boards, mounting bars, grids or the like. The display hooks support a plurality of items of merchandise, which can be extracted individually by customers and replenished with new merchandise when the hook is emptied or depleted. In particular, the invention relates to product display hooks that are designed to support bottled or otherwise packaged products by engaging a neck, flange, cap or the like, at the top of the bottle or other package.

BACKGROUND OF THE INVENTION

For certain types of products, including but not limited to bottled or packaged products having a cap the top, it may be desirable and more convenient to display the products for sale by suspending them from their caps, flanges or other elements at the top of the package. A variety of display devices are available for this purpose. Examples of these are the Kinseley U.S. Pat. No. 4,863,131, Gollob et al. U.S. Pat. No. 5,785,189, Spammer et al U.S. Pat. No. 5,865,326, and Hartwall U.S. Pat. No. 6,394,288. A shortcoming of these devices is that they all require front loading, meaning that new products must always be loaded from the front of the device. When displaying food products, or other products having a limited shelf life, it is very important that the display hooks be loaded properly, with new items always being placed at the back of the display, and older items be being moved to the front of the display, where they will be removed first by the customers. In order to assure that the merchandise on a front-loading display device is as fresh as practicable, one must either allow the display hook to be fully depleted before reloading, or remove any unsold products, load new products onto the back of the display, and then replace the unsold products at the front of the hook. This sometimes may not done properly, because of the extra time and effort required of the store employee.

The shortcomings of the front-loading arrangements described in the foregoing paragraph are partly resolved in display mechanisms represented by the Spamer et al U.S. Pat. No. 5,586,687 , and Trulaske No. 6,523,719. These devices allow back loading of the display. However, the loading must be in the direction of the axis of the display, which requires that open space be provided behind the display to allow a product to be positioned behind the display for loading. Moreover, these back-loading displays require special support structure in order to provide for the necessary space behind the display device.

Another form of display that permits loading of product at the rear of the display is that shown in the Merl U.S. Pat. No. 4,310,097. In that device, product bottles, which are supported by their necks, are loaded downwardly into the back of the display through a large open space at the back of the display. While this makes it possible for products to be back-loaded into the display, the Merl display device makes the process somewhat cumbersome, in that products are loaded from above the display. This requires the entire bottle to be gripped by its neck or top, lowered into the display and then moved forward until the neck of the bottle is engaged by spaced apart supports. A "catch basin" is provided to enable bottles, dropped during loading, to be retrieved.

SUMMARY OF THE INVENTION

The present invention is directed to a novel form of back-loading display hook which is both greatly improved and greatly simplified in comparison to available display devices. The device of the invention can be constructed in an economical manner, of wire rod material commonly utilized in the manufacture of display hooks, and can be loaded from the back of the hook, by moving the product upward into a loading position at the back of the hook and then forward until the cap, neck or other part of the top structure of the product or container is fully supported by forwardly extending portions of the display hook. Loading from underneath is significantly easier and more efficient than loading from above or from behind.

In a preferred embodiment of the invention, the display hook is formed from a single length of wire rod. The wire rod is shaped and formed to provide a section of parallel wires spaced to engage and support the cap of a product package or container. A loading position is provided at the back of the hook, where the wires are spaced farther apart, forming a wider space, sufficient to allow the cap of the product package to be inserted upwardly between the wires. The product package is then moved forwardly until the cap is supported by the more narrowly spaced forward portions of the wires. If desired, as in the preferred and illustrated embodiment of the invention, the forward portions of the support wires may be tilted downward to provide for an automatic forward feeding of the products by the action of gravity.

After a product package has been position on the forward portions of the support wires, it is prevented from being accidentally moved rearwardly, back into the loading position, by means of a displaceable stop element. The stop element, which normally blocks rearward entry of a package into the loading position, is displaceable upwardly by the product package, when the product is being inserted upwardly into the loading position, and returns to it's normal stop position, as soon as the product is moved forward from the loading position. An advantageous form of stop element is a flat, flexible element, which extends forwardly from a mounting base of the hook and is upwardly displaceable by the package when a product package is loaded onto the hook. As soon as a product package moves forward from the loading position, the stop element automatically returns to its normal position to prevent the product from re-entering the loading position if pushed rearwardly from the front.

Forward portions of the wire hook are bent upwardly to form a temporary forward limit position for loaded product packages. Above the upwardly bent portions, the wire rod elements extend divergently upward and are connected at the top, forming a "window" somewhat in the form of an inverted triangle, through which the container cap can be passed when a customer retrieves a product from the display. To advantage, a label holder is pivoted at the top of the window and normally is positioned in front of the window to provide product pricing and information. When a product is retrieved from the display hook, the label holder pivots upward to allow the product cap to pass through the window.

For a more complete understanding of the above and other features and advantages of the invention, reference should be made to the following detailed description of preferred embodiments of the invention, and to the accompanying drawings.

DETAILED DESCRIPTION OF THE INVENTION

Figure 1:
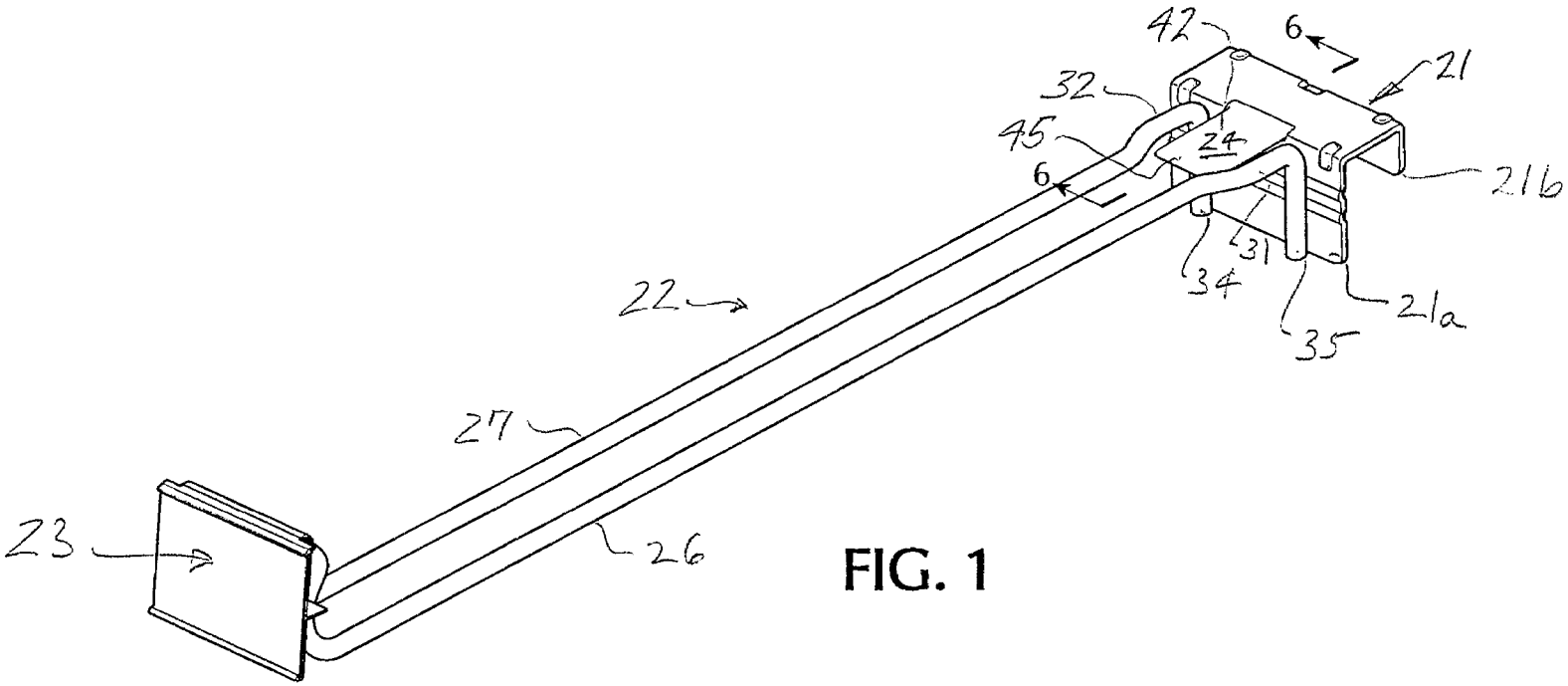
FIG. 1 is a perspective view from the front of an advantageous form of product display hook incorporating features of the invention.
Figure 2:
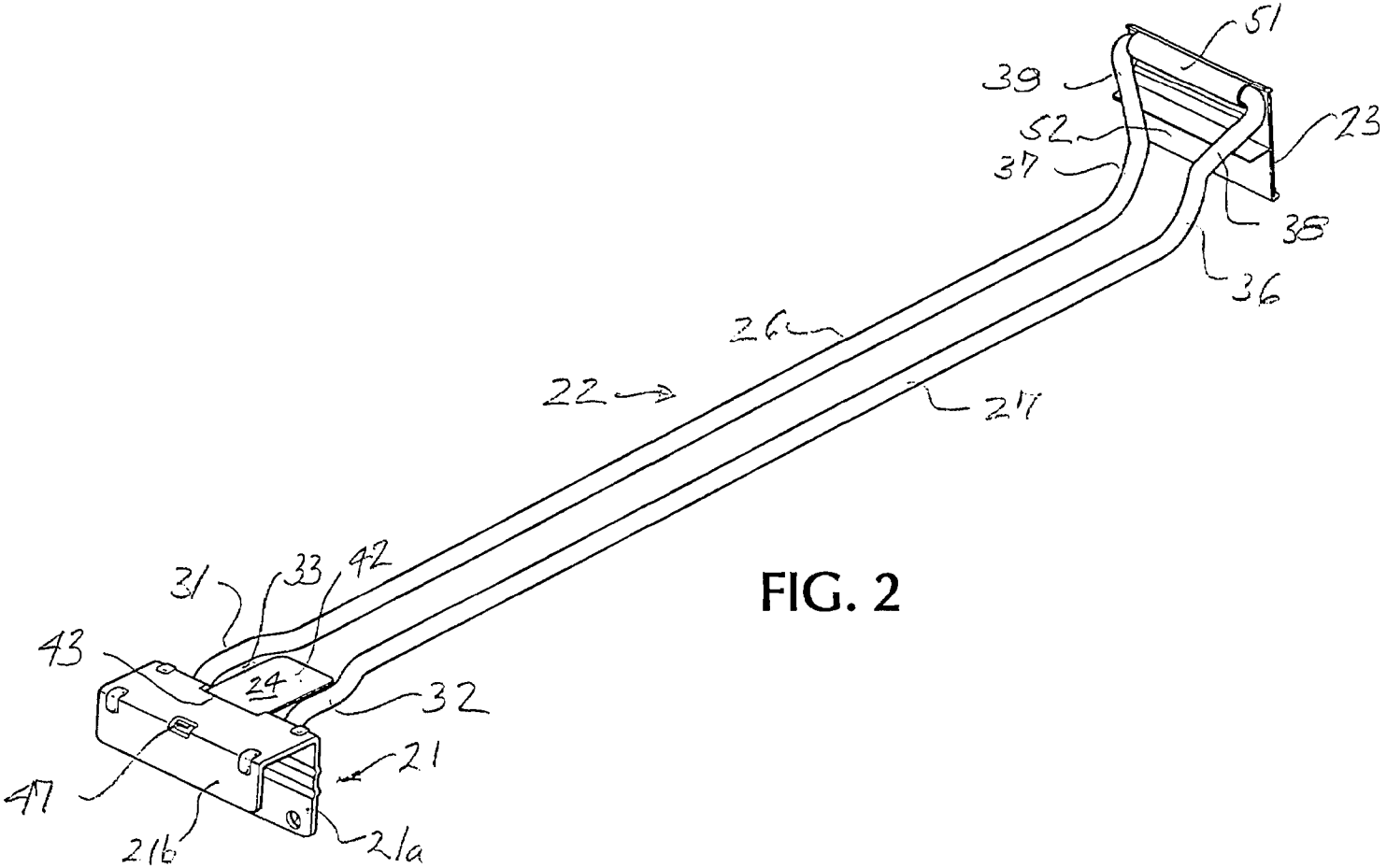
FIG. 2 is a perspective view, from the rear, of the product display hook of FIG. 1.
Figure 3:
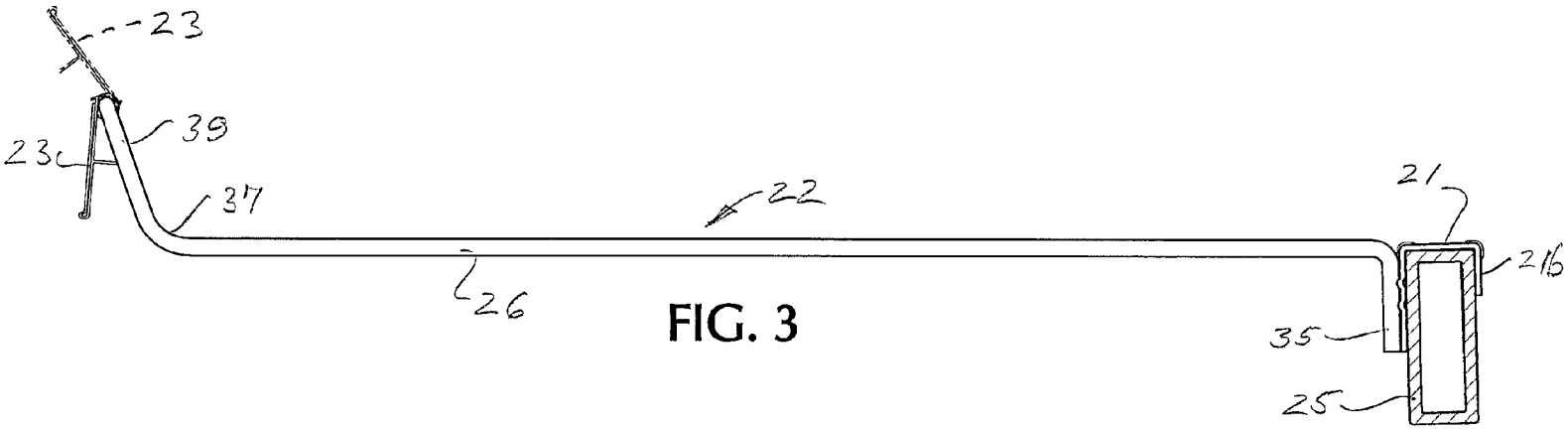
FIG. 3 is a side elevational view of the product display hook of FIG. 1.
Figure 4:
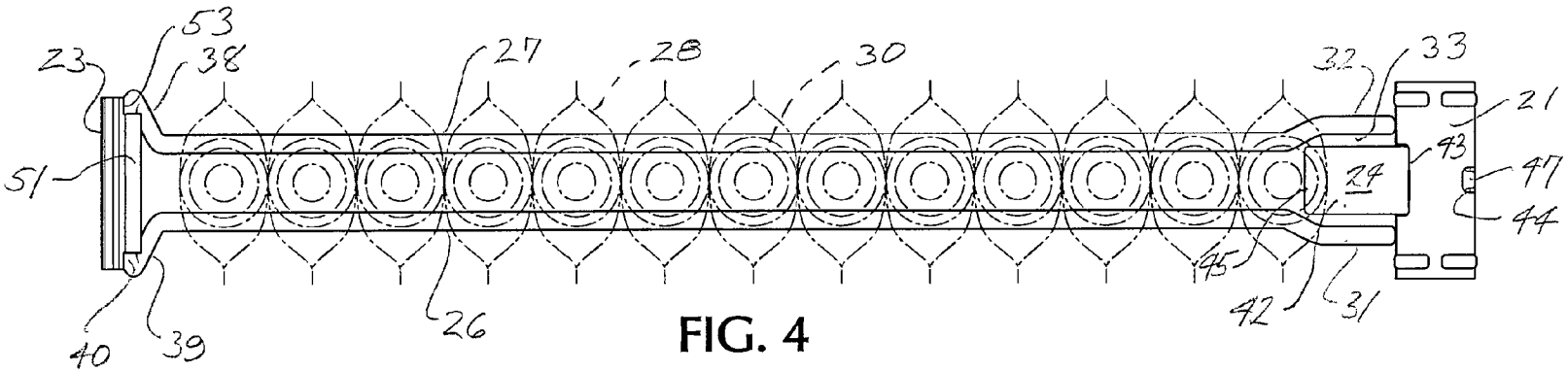
FIG. 4 is a top plan view of a display hook according to the invention, showing the hook loaded with product items.

Referring to the drawings, FIGS. 1-3 illustrate a preferred form of display and dispensing hook according to the invention. The hook comprises a mounting base 21, a forwardly extending wire section 22, a label holder 23 at the forward extremity of the hook, and a stop element 24 extending forwardly from the mounting base 21. The mounting base 21 maybe formed of sheet metal and is shaped in an inverted J-shaped configuration to fit over a rectangular mounting bar 25. In the illustrated form of the invention, the wire section 22 of the hook is formed of a continuous length of wire rod of, for example, 0.250 inch diameter. The continuous length of wire includes support elements 26, 27 extending forwardly in parallel relation, with a predetermined lateral separation suitable for the intended product containers 28, shown in FIGS. 4 and 10.

In the illustrated system, the product containers 28 are in the form of soft bags, made of plastic material and containing a liquid or semi-liquid food product, such as baby foods, having a relatively limited shelf life. However, the invention is not limited to particular types of containers or to particular products. At their tops, the containers 28 are formed with narrowed neck portions 29 (FIG. 10) of a first transverse dimension, and the separation of the wire support elements 26, 27 is such as to closely confine the neck portions 29 while allowing the containers 28 to slide easily along the wires. The product containers 28 are provided with the enlarged caps 30, the diameter of which is of a second transverse dimension, wich is greater than said first transverse dimension and greater than the lateral spacing between the wire support elements 26, 27 of the display hook. Preferably, the product caps 30 are relatively flat across the bottom, so that they rest on the uppermost surfaces of the wire support elements 26, 27.

In a representative, but non-limiting example, the caps 30 may have a diameter across the bottom of about 1.35 inch. In the illustrated example the bottom dimension represents the maximum diameter of the cap. Caps of this size can be reliably supported on wire support elements 26, 27 spaced apart approximately 0.85 inch. Although the invention is designed specifically for the support of products of the general type illustrated, it should be understood that neither the products nor the packages themselves form a part of the invention. Moreover, it should be understood that, unless the context indicates otherwise, the terms "product", "package", and "container" may be used interchangeably herein to refer to the item or items supported by the display device of the invention.

In accordance with an aspect of the invention, the lateral spacing between the wire support elements 26, 27 is enlarged at the innermost ends 31, 32 of the wires, immediately adjacent to the mounting base 21, to form a product loading position 33. The enlarged spacing between the wire elements 31, 32 may be approximately 1.38 inch, which is equal to or slightly greater than the diameter of the container caps 30, although less than the width of the container bodies. The length of the loading position 33, defined by the elements 31, 32, is also slightly greater than the diameter of the caps 30, such that the cap 30 of a vertically oriented package 28 can be inserted vertically upward through the enlarged opening until the cap lies above the level of the wire support elements 26, 27, after which the package 28 may be moved forwardly until the bottom of the cap 30 is fully supported by the wire elements 26, 27. Additional product containers 28 can be loaded into the back of the display hook through the loading position 33, until the capacity of the hook has been reached.

In the illustrated device, the innermost ends 34, 35 of the wires are bent downward and fixed to the mounting base 21, typically by welding. However, various alternative arrangements can be employed for mounting of the hooks, including, for example, configuring the innermost ends of the hook to be received in openings of an apertured panel board.

Figure 7:
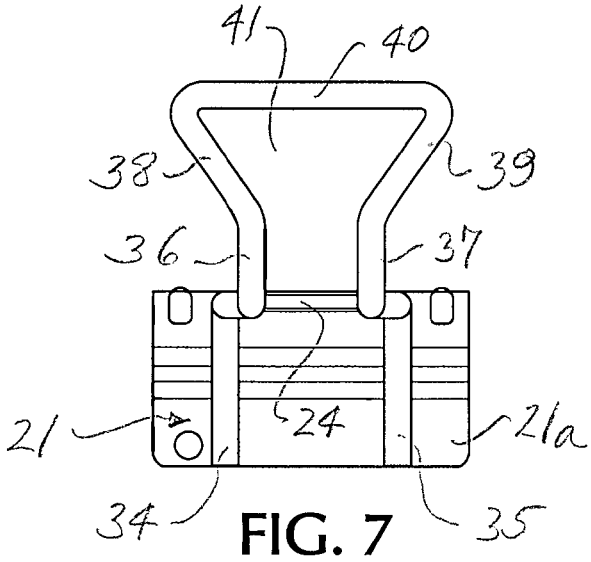
FIG. 7 is a front elevational view, similar to FIG. 5, but with the label holder removed to illustrate the configuration of the wire at the front of the hook.

As indicated in FIGS. 3 and 7, the wire support elements 26, 27 are upturned at their outer ends 36, 37 to form a barrier to forward sliding movement of the product containers 28. The spacing between the upturned ends 36, 37 is sufficient to allow passage of the necks 29 of the containers, but not their caps 30. Above the upturned ends 36, 37, the wire elements extend upwardly and laterally outward at 38, 39, at a relatively wide angle of, say, 68°. The upper ends of the elements 38, 39 are connected by a horizontal wire element 40. The wire elements 38-40 define a "window" opening 41, preferably of inverted triangular shape and of sufficient size to accommodate passage of the container caps 30. Thus, for a customer to remove a package supported on the hook, the body of the package is gripped and pulled forward and tipped up slightly such that the cap 30 slides upward along the upturned portions 36, 37 and exits through the opening 41.

As shown in FIG. 3, the upturned ends 36, 37 of the wire are formed on a generous radius, for example 0.63 inch, and the forward end portions of the hook, defining the opening 41, are tilted forwardly at an angle of, for example, 110° relative to the support elements 26, 27, to facilitate removal of a suspended product from the hook.

Figure 6:
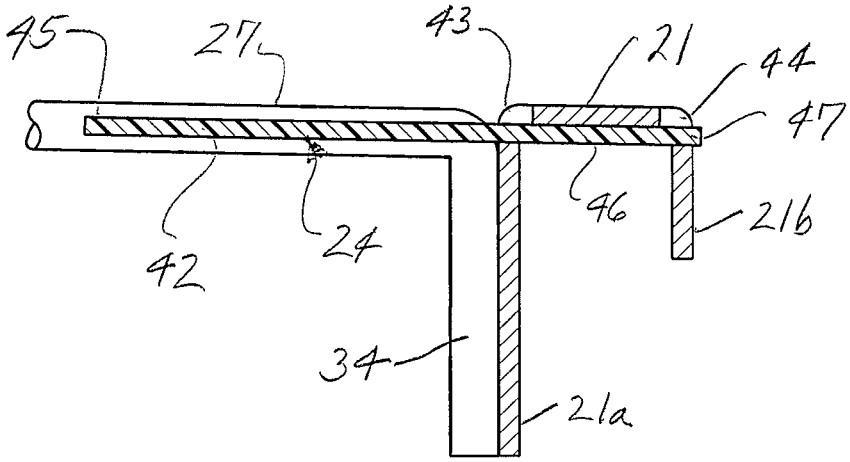
FIG. 6 is an enlarged, fragmentary cross-sectional view as taken generally along line 6-6 of FIG. 1.

In accordance with a feature of the invention, a stop element 24 is positioned in the loading position 33 to prevent product containers, previously loaded onto the support elements 26, 27, from being displaced rearwardly back into the loading position, where they might fall through the enlarged opening. A preferred form of stop element is a normally flat but somewhat flexible tongue 42 (FIG. 6) that is secured in the mounting base 21 and extends forwardly therefrom between the two wire sections 31, 32 defining the loading position 33. In the illustrated form of the invention, the mounting base 21 is provided with a slot 43 at the top of its front wall 21*a*, and a second slot 44 at the top of its back wall 21*b*, as shown in FIG. 6. The tongue 42 can be installed in the mounting base 21 by inserting a forward portion 45 thereof through the forward slot 43 and pushing a rear portion 46 of the tongue upwardly between the front and back walls of the mounting base, until a small tab 47 at the rear of the tongue snaps through the slot 44 in the back wall of the mounting base. The rear portion 46 of the tongue is somewhat wider than the width of the slots 43, 44 such that, once installed in the mounting base, as shown in FIG. 6, the tongue is fixed in place. As shown in FIG. 1, the forward portion 45 of the tongue 42 extends forwardly substantially to the converging forward portions of the loading station, in a position to engage the neck of an adjacent container and prevent it from being accidentally displaced rearwardly, back into the loading position.

Figure 5:
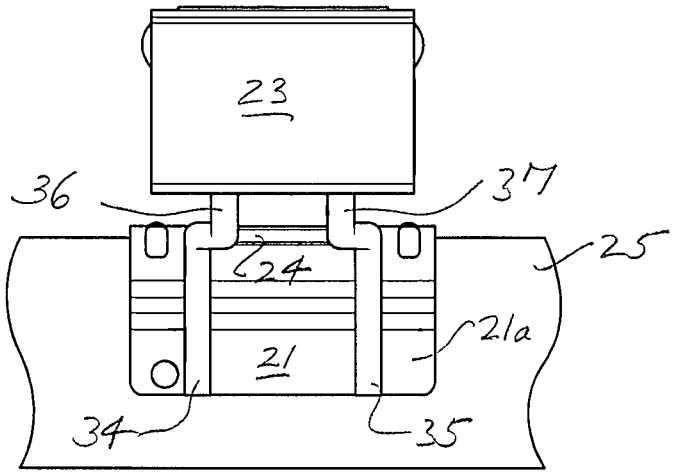
FIG. 5 is a front elevational view of the product display hook of FIG. 1.
Figure 8:
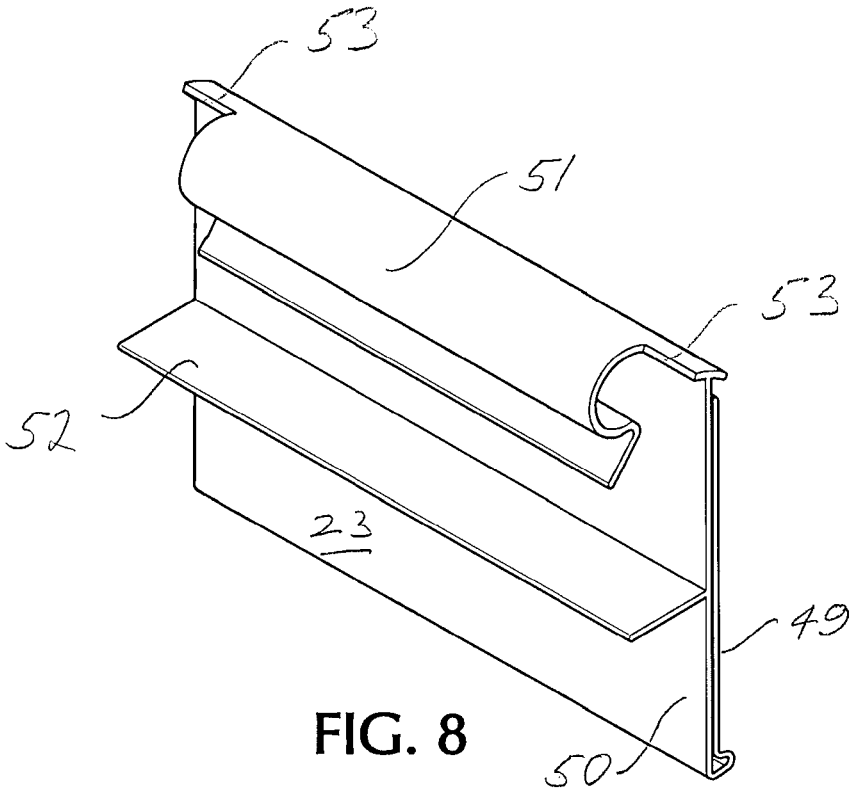
FIG. 8 is a perspective from the back of an advantageous form of label holder utilized in connection with the display hook of FIG. 1.
Figure 9:
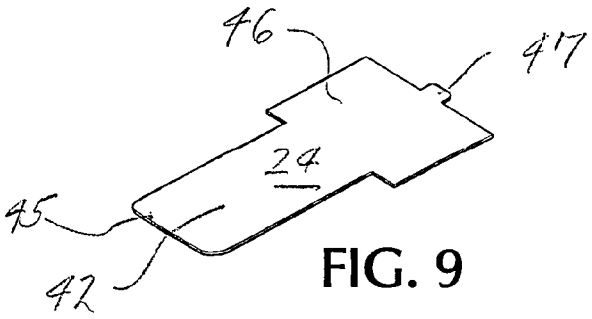
FIG. 9 is a perspective view of a flexible stop element forming part of the display hook of FIG. 1.

In a preferred embodiment of the invention, the label holder 23 (FIG. 8) is mounted on the horizontal wire element 40 at the front of the display hook. The label holder has front and back panels 49, 50 for holding a label (not shown) containing pricing and other product information. The width of the label holder is approximately equal to the width of the wire elements forming the opening 41, and a clip 51 at the back of the label holder is arranged to snap over the horizontal wire element 40 to mount the label holder for pivotal movement with respect to the wire element 40. The back panel 50 the label holder may be provided with a transverse rib 52 positioned to engage the upwardly extending wires 38, 39 at the front of the label holder, in order to tilt the label holder upward somewhat to provide a preferred viewing angle for the customer. Normally, the label holder 48 is suspended in front of the product removal opening 41, as shown in FIG. 1 and FIG. 5. When a product is removed from the display hook, the product cap 30 passes through the opening 41 and in doing so tilts the label holder 48 upward and out of the way.

To advantage, the label holder is configured in a way that prevents upward rotation thereof, during product removal, into or beyond a vertical position. This assures that, after removal of the product, the label holder will automatically pivot back to its normal position, in front of the product removal opening 41. As shown particularly in FIG. 8, the panels 49, 50 of the label holder extend laterally beyond the ends of the mounting clip 51. Since the label holder is an extruded item, the mounting clip initially will have the same length as the panels 49, 50. However, end portions of the clip 51 are trimmed away, leaving abutment surfaces 53 at each end. These abutment surfaces are positioned to engage back surfaces of the wire elements 38, 39 at an upper rotational limit of the label holder (e.g. as illustrated in broken lines in FIG. 3), prior to its reaching a vertical position, so that the label holder automatically returns by gravity as soon as the withdrawn product is removed from in front of the hook.

Figure 10:
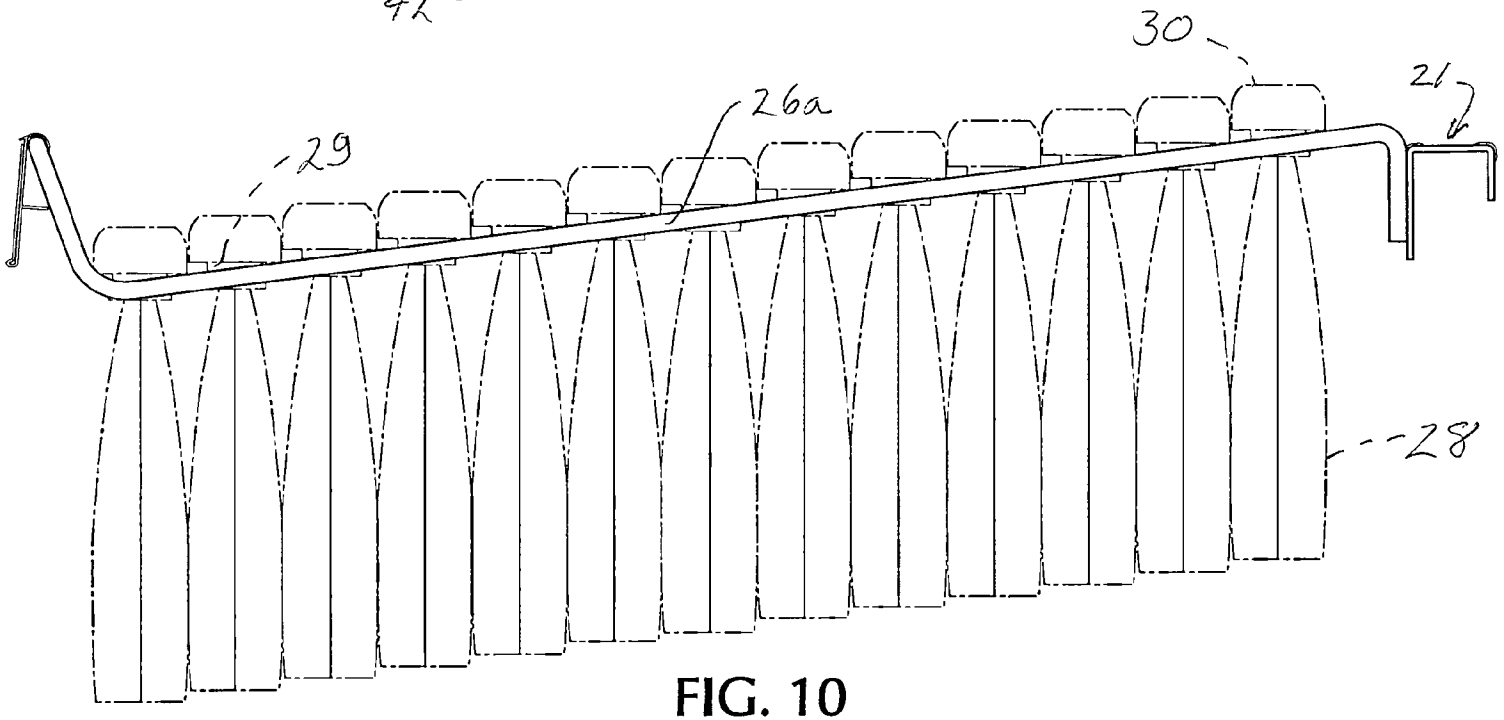
FIG. 10 is a side elevational view of the display hook according to the invention, shown fully loaded with product items, and configured to provide a gravity feed of products to the front of the hook.

FIG. 10 shows an alternative form of the invention, in which outwardly extending wire support elements 26*a*, 27*a* are tilted downwardly, from back to front. This has an advantage of allowing the product containers 28 to slide forwardly by the action of gravity, so that the product is always "fronted" in a desirable manner without the intervention of store personnel. The horizontal version of the invention occupies somewhat less vertical space in the store display than the embodiment of FIG. 10, in which the support elements are downwardly inclined. The storekeeper is thus able to choose the most suitable alternative depending upon the particular requirements of the display.

The device of the invention represents a significant improvement over standard display hook arrangements in providing for a simplified and economical form of back-loading hook, in which products are easily and efficiently loaded by lifting the product or container upwardly to insert its cap into the loading position at the back of the hook and moving it forward until engaged by the support elements 26, 27. The arrangement provides for easy and highly efficient loading in a manner to assure that the oldest products are always at the front of the display, and thus maintaining a desired first in-first out inventory management. The device of the invention is of simplified construction and is economical to manufacture, yet is highly functional for the purposes intended.

It should be understood, of course, that the specific preferred embodiments of the invention illustrated and described herein are intended to be representative only, and not by way of limitation, as many variations may be made therein without departing from the clear teachings of the invention. Accordingly reference should be made to the following appended claims in determining the full scope of the invention.

What is claimed is:

1. A back-loading display and dispensing hook, specially adapted for the support and display of products of a type having a necked top configuration including a body portion, a neck portion joined with and positioned above said body portion and having a first transverse dimension, and a top portion joined with and positioned above said neck portion and having a second transverse dimension greater than said first transverse dimension, which comprises, a base structure adapted to be mounted on a display support structure, first and second product support elements joined with and mounted by said base structure and extending forward therefrom in spaced apart generally parallel relation, said product support elements being laterally spaced apart, over a forward portion thereof, a distance at least slightly greater than said first transverse dimension and less than said second transverse dimension whereby products may be suspended on said product support elements by top portions of such products, a barrier structure at a forward end of said product support elements positioned to block forward movement of products suspended on said product support elements, said product support elements being laterally spaced apart, for a limited distance at back portions thereof, a distance which is equal to or greater than said second transverse dimension to form a loading position enabling products to be loaded onto said product support elements by passing top portions of products upwardly between said product support elements at said loading position and thereafter moving such products forwardly until the top portions thereof can be engaged and supported by forward portions of said product support elements, a resiliently displaceable structure associated with said loading position to obstruct movement of loaded product in a rearward direction back into said loading position, and a product release structure associated with said barrier structure to enable intended removal of products from a front of said display hook.

2. A back-loading display and dispensing hook according to claim 1, wherein said resiliently displaceable structure comprises a resilient stop element mounted on said base structure and extending into said loading position to prevent movement of loaded product in a rearward direction into said loading position, and said stop element is resiliently displaceable by upward movement of a product top portion into said loading position.

3. A back-loading display and dispensing hook according to claim 2, wherein said stop element comprises an element mounted at a back end thereof and having a flexible forward portion extending forward into said loading position into a position to engage a product and prevent its rearward movement into said loading position, and the forward portion of said stop element is upwardly displaceable by a product being inserted upwardly into said loading position.

4. A back-loading display and dispensing hook according to claim 1, wherein said barrier structure comprises upwardly directed elements at forward ends of said product support elements, said product release structure comprises first and second release elements extending upward and laterally outward at an upwardly divergent angle from respective upwardly directed elements of said barrier structure, and a third release element extending transversely between and joined with upper ends of said first and second release elements, said release elements forming a product release window of an inverted triangular shape and of a size to enable a product top portion to be passed through and removed from the front of the display hook.

5. A back-loading display and dispensing hook according to claim 4, wherein said third release element extends horizontally between upper-outer ends of said first and second release elements, a label holder is pivotally mounted on said third release element and extends in front of said first and second release elements, and said label holder is pivotable forwardly and upwardly to accommodate passage of a product top portion through said window.

6. A back-loading display and dispensing hook according to claim 5, wherein said third release element comprises a cylindrical, wire-like section, said label holder has a pivot clip extending along its upper edge and wrapped partially around said wire-like section and mounting said label holder for pivoting movement, rear portions of said pivot clip are cut-away at each end extremity thereof to form a truncated rear center portion of said pivot clip which can freely pivot about said wire-like section between the respective first and second release elements, and portions of said end extremities of said pivot clip are positioned to engage and abut back surfaces of the divergently disposed first and second release elements to prevent pivoting of said label holder into or beyond a vertical position, whereby the label holder reliably returns by gravity to a position in front of said window, after a product has been removed through said window.

7. A back-loading display and dispensing hook according to claim 4, wherein said product support elements, said upwardly directed barrier elements, and said release elements are formed of a continuous length of wire rod.

8. A back-loading display and dispensing hook according to claim 7, wherein said base structure comprises a back plate element, and rearward ends of said continuous length of wire rod are fixed to said base structure.

9. A back-loading display and dispensing hook according to claim 7, wherein said product support elements are disposed at a downward angle to said base structure such that, when said base structure is mounted on a support structure, products supported on said product support elements by top portions of said products will tend to slide downward and forward on said product support elements.

10. A back-loading display and dispensing hook according to claim 1, wherein said base structure includes a metal back plate to which rearward ends of said support elements are fixed, and said back plate extends laterally between said rearward ends at a back of said loading position and forms a back end of said loading position.

11. A back-loading display and dispensing hook, specially adapted for the support and display of products of a type including a body portion, a neck portion joined with and positioned above said body portion and having a first transverse dimension, and a top portion joined with and positioned above said neck portion and having a second transverse dimension greater than said first transverse dimension, which comprises, a pair of spaced-apart elements adapted to be mounted by rear end portions thereof to a display structure and to extend forward therefrom in spaced-apart, generally parallel relation, said spaced apart elements having rear-most portions thereof laterally spaced apart a distance which is equal to or greater than said second transverse dimension, said rear-most portions forming a loading position enabling a product top portion to be loaded in an upward direction into said loading position and then moved forwardly onto forward portions of said spaced-apart elements, said forward portions of said spaced-apart elements being laterally spaced apart a distance slightly greater than said first transverse dimension and less than said second transverse dimension to form product supports, whereby loaded products may be suspended on said product supports by the top portions of such said products, a resiliently displaceable stop element positioned to obstruct said loading position to obstruct rearward movement of suspended products into said loading position, and barrier elements integrally joined with forward ends of said product supports and positioned to restrict forward sliding of products.

12. A back-loading display and dispensing hook according to claim 11, wherein said stop element comprises a resilient element mounted at a back end thereof and having a flexible tongue portion at a front portion thereof extending forward into said loading position, said flexible tongue portion being resiliently upwardly displaceable by a product being inserted upwardly into said loading position.

13. A back-loading display and dispensing hook according to claim 12, wherein a mounting base, formed of sheet metal and of generally inverted J-shaped configuration, is provided for mounting said hook to the display structure, said spaced apart elements being fixed to a front side of said mounting base, said mounting base having openings in front and rear sides thereof for the reception and support of spaced apart back portions of said stop element, said flexible tongue portion of said stop element projects forward from said mounting base into said loading position, and said stop element is formed of flat, resilient material and said flexible tongue portion thereof is displaceable upwardly, to permit loading of product at said loading position, while having sufficient stiffness to prevent products, supported on forward portions of said product support elements, from moving rearwardly into said loading position.

14. A back-loading display and dispensing hook according to claim 11, wherein said spaced apart elements are formed by wire rod, said barrier elements are upwardly directed elements formed of said wire rod, integrally joined with forward ends of said product supports and positioned to block forward sliding of said product, a product release structure, formed of said wire rod, is integrally joined with upper ends of said barrier elements and defines a product release window above said barrier elements of sufficient size to enable forward pass-through of top portions of said products, said product release structure comprises first and second release elements integrally joined with and extending upward and laterally outward at an upwardly divergent angle from respective ones of said barrier elements, and a third release element integrally joined with and extending horizontally between upper, outer ends of said first and second release elements such that said product release window is in the form of an inverted triangle, a label holder is pivotally attached to said third release element and hangs downwardly therefrom in front of said product release window, and said label holder includes opposite side edge portions engageable with back surface portions of the divergently disposed first and second release elements to prevent upward pivotal rotation of said label holder into a vertically upward orientation, such that said label holder reliably returns to a downwardly hanging position in front of said release window after a product is removed through said release window.

15. A back-loading display and dispensing hook according to claim 11, wherein said base structure includes a mounting base, separate from said length of wire, to which the opposite rearward ends of said wire are fixed, and said base structure extends laterally between said rearward ends at a back of said loading position.

16. A back-loading display and dispensing hook according to claim 11, wherein said product support elements are disposed at a downward and outward angle with respect to said display structure, whereby products, supported on said product support elements by top portions of said products, will tend to slide downward and forward by gravity on said product support elements.

* * * * *